US009497848B2

(12) United States Patent
Almási et al.

(10) Patent No.: US 9,497,848 B2
(45) Date of Patent: Nov. 15, 2016

(54) METHOD AND SETUP TO MANIPULATE ELECTRICALLY CHARGED PARTICLES

(71) Applicant: University of Pécs, Pécs (DE)

(72) Inventors: Gábor Almási, Kozármisleny (HU); József András Fülöp, Pécs (HU); János Hebling, Pécs (HU); Mátyás Mechler, Siófok (HU); László Pálfalvi, Pécs (HU)

(73) Assignee: University of Pécs, Pécs (HU)

( * ) Notice: Subject to any disclaimer, the term of this patent is extended or adjusted under 35 U.S.C. 154(b) by 157 days.

(21) Appl. No.: 14/399,855

(22) PCT Filed: May 9, 2013

(86) PCT No.: PCT/HU2013/000044
§ 371 (c)(1),
(2) Date: Nov. 7, 2014

(87) PCT Pub. No.: WO2013/175248
PCT Pub. Date: Nov. 28, 2013

(65) Prior Publication Data

US 2015/0145404 A1 May 28, 2015

(30) Foreign Application Priority Data

May 9, 2012 (HU) ..... 1200273

(51) Int. Cl.
*H05H 9/00* (2006.01)
*H05H 15/00* (2006.01)

(52) U.S. Cl.
CPC ..... *H05H 9/00* (2013.01); *H05H 15/00* (2013.01)

(58) Field of Classification Search
CPC ..... H05H 9/00; H05H 15/00; H05H 1/00; H05H 1/54; H01J 27/028; H01J 27/02; H01J 37/08
See application file for complete search history.

(56) References Cited

U.S. PATENT DOCUMENTS 3,267,383 A 8/1966 Lohmann
6,867,419 B2 3/2005 Tajima (Continued)

OTHER PUBLICATIONS

Haberberger et al., "Collisionless shocks in laser-produced plasma generate monoenergetic high-energy proton beams" [Nature Physics 8, (2012)]; 5 pages.

(Continued)

*Primary Examiner* — Anne Hines
*Assistant Examiner* — Jose M Diaz
(74) *Attorney, Agent, or Firm* — Fitch, Even, Tabin & Flannery LLP

(57) ABSTRACT

The invention relates to a such particle accelerator setup (1, 11) and method based on the total reflection of electromagnetic pulses with a frequency falling into the THz frequency domain that utilize the evanescent field for the acceleration of electrically charged particles. Said setup includes a radiation source (5) to emit high-energy THz-pulses, preferably comprising a few optical cycles, having a large peak electric field strength, as well as two optical elements (2, 12) in the form of a pair of bulk crystals made of a substance that exhibits large refractive index, low dispersion and high optical destruction threshold, wherein said optical elements are transparent for the THz radiation. The inventive solutions represent much simpler, more compact and more cost effective alternatives compared to the prior art particle accelerator setups.

22 Claims, 2 Drawing Sheets

(56) References Cited

U.S. PATENT DOCUMENTS

| | | | | |
|---|---|---|---|---|
| 6,909,764 | B2 | 6/2005 | Maksimchuk et al. | |
| 2009/0104179 | A1* | 4/2009 | Boyden ..... | A61K 41/0042 424/130.1 |

OTHER PUBLICATIONS

J. D. Jackson; "Classical Electrodynamics", Third Edition, Wiley, 1999, ISBN 047130932X, 9780471309321, Hungarian language; 8 pages (327-334).
J. Hebling, et al.; "Velocity matching by pulse front tilting for large area THz-pulse generation"; [Opt. Expr. 10, 1, 161 (2002)]); 6 pages.
H. Hiroi, et al.; "Single-cycle terahertz pulses with amplitudes exceeding 1 MV/cm generated by optical rectification in LiNb03"; [Appl. Phys. Lett. 98- 091106 (2011)]; 3 pages.
J. A. Fülöp, et al.; "Towards generation of mJ-level ultrashort THz pulses by optical rectification"; [Opt. Expr. 19, 15090 (2011)].; 8 pages.
Reference book, "Handbook of Optical Constants of Solids l"; (published by Academic Press, New York, 1985, edited by E. D. Palik); 31 pages.
L. Pálfalvi, et al.; "Novel setups for extremely high power single-cycle terahertz pulse generation by optical recfification"; Appl. Phys. Lett. 92, 171107 (2008)]; 4 pages.
Frandsen et al.; "Acceleration of Free Electrons in a Symmetric Evanescent Wave"; Laser Physics, vol. 16, No. 9, 2006; 4 pages.
Welsh et al.; "Terahertz-Pulse Emission Through Laser Excitation of Surface Plasmons in a Metal Grating"; Physical Review Letters, vol. 98; Jan. 12, 2007; 4 pages.
Pálfalvi et al.; "Temperature Dependence of the Absorption and Refraction of Mg-Doped Congruent and Stoichiometric LiNbO3 in the THz range"; Journal of Applied Physics, vol. 97, 2005; 6 pages.
Wang et al.; "Forward and Backward Terahertz-Wave Difference-Frequency Generations From Periodically Poled Lithium Niobate"; Optics Express, vol. 16, No. 9; 2008; 8 pages.
Rabiei et al.; "Optical and Electro-Optical Properties of Submicrometer Lithium Niobate Slab Waveguides Prepared by Crystal Ion Slicing and Wafer Bonding"; Applied Physical Letters, vol. 85, No. 20; Nov. 15, 2004; 3 pages.
Koschmieder, T.H.; "Evanescent Wave Acceleration of Electrons From 0.2c to 0.95c"; Particle Accelerators, vol. 48; 1994; 9 pages.
Singh et al.; "A Laser-Driven Particle Accelerator with Optical Grating"; Retrieved from the Internet at http://www.nuclear.jp/icfa/GIENS/workshop_papers/giens04.pdf; retrieved on Oct. 3, 2013; 6 pages.
Fernow, R.C.; "Acceleration Using Total Internal Reflection"; Center for Accelerator Physics, Physics Department, Brookhaven National Laboratory, Long Island, NY; Jun. 7, 1991; 18 pages.
Mikhailchenko, A.A.; "Laser Linear Collider With a Travelling Laser Focus Supply"; 1999 Particle Accelerator Conference, New York; 3 pages.
Hebling et al.; "THz Pulse Technology Brings New Hope to Cancer Sufferers"; 2011; 2 pages.
Henig, A., et al.; "Enhanced Laser-Driven Ion Acceleration in the Relativistic Transparency Regime"; Physical Review Letters; PRL 103, 045002; Jul. 24, 2009; 4 pages.
Maksimchuk, A., et al.; "Forward Ion Acceleration in Thin Films Driven by a High-Intensity Laser"; Physical Review Letters, vol. 84, No. 18; May 1, 2000; 4 pages.
Robson, L., et al.; "Scaling of Proton Acceleration Driven by Petawatt-Laser-Plasma Interactions"; published online on Dec. 10, 2006; Nature Physics, vol. 3, Jan. 2007; 5 pages.
Ter-Avetisyan, S., et al.; "First Demonstration of Collimation and Monochromatisation of a Laser Accelerated Proton Burst"; Laser and Particle Beams (2008), vol. 26; 12 pages.
International Search Report of PCT/HU2013/000044 dated Nov. 28, 2013; 4 pages.

* cited by examiner

METHOD AND SETUP TO MANIPULATE ELECTRICALLY CHARGED PARTICLES

CROSS-REFERENCE TO RELATED APPLICATIONS

This application is the National Stage of International Application No. PCT/HU2013/000044, filed May 9, 2013, which claims priority to Hungarian Patent Application No. HU P1200273 filed May 9, 2012.

The present invention relates to a method and to a setup to manipulate particles carrying electrical charge. In particular, the present invention relates to a method and to a setup to accelerate electrically charged particles and/or bunches of particles, as well as, optionally, to narrow the energy spread thereof.

It is well-known that to accelerate electrically charged particles (such as electrons, protons or any other ions) and/or bunches thereof is an enormous task of extremely high costs and also requires large infrastructurel facilities, as well as space. However, it is of high importance due to the wide application field. Hadron therapy is an example of such significant applications; it is a tool to destroy malignant cells much more selectively than what is achievable by means of a therapy based on a cobalt-therapy gun. To this end, ions have to be accelerated to energies falling between 10 MeV and 200 MeV (this traditionally takes place by means of a linac or a cyclotron). In human tissues, ions get absorbed and thus exert a destructive effect only at a given depth determined by their energy. In this way, by means of properly choosing the ion energy, as well as setting and maintaining this value in a relatively precise way (that is, along with a least possible energy spread of the ions forming the therepautical beam), it can be achieved that practically only the malignant tissue of the body gets destructed, while the healthy tissue located along the trajectory of the ion beam in front of the malignant one is hardly effected and the tissue located behind it remains essentially unaffected.

Accelerating ions (protons) to a desired energy level takes place, in general, in more than one steps. In traditional accelerators, a static electric field is applied for the pre-acceleration, then the pre-accelerated beam of ions is coupled into a linear or cyclotron accelerator operated by a microwave radiation. To couple in, there is a need for a proper synchronization between the ion beam and the electromagnetic field used to accelerate further. This requires the application of expensive supplementary means. To direct the accelerated beam to a proper position represents a yet further difficulty, especially in case of cancer therapy applications.

It is a long-standing effort to find a solution for accelerating electrically charged particles that is simpler and more compact than the techniques known today, more promising compared to microwave-driven accelerators as to the above mentioned applications, and also addresses (in a relatively simple manner) the problem of synchronization.

A CPA-based (Chirped Pulse Amplification) laser-driven ion accelerator having an ion source and operated by a high-energy light pulse (generated by a Ti:sapphire laser) is proposed in U.S. Pat. Nos. 6,906,338 B2 and 6,867,419 B2 (Tajima). The total distance from the source of light pulse to the target plane where the accelerated ion beam is used is several meters (the dimension of the ion source itself is several centimeters). An ion energy of at most about 10 MeV can be achieved through these systems.

Most applications require a collimated ion beam. The paper by Maksimchuk et al. entitled *Forward Ion Acceleration in Thin Films Driven by a High-Intensity Laser* [Phys. Rev. Lett. 84, 4108 (2000)] and U.S. Pat. No. 6,909,764 B2 disclose a method for generating a collimated beam of protons with energies as high as 1.5 MeV, wherein sub-picosecond laser pulses of high intensity and high contrast are focused onto a thin foil target.

Furthermore, the scientific paper by Henig et al. entitled *Enhanced Laser-Driven Ion Acceleration in the Relativistic Transparency Regime* [Phys. Rev. Lett. 103, 045002 (2009)] teaches the acceleration of proton and carbon ion beams by means of extreme high-intensity laser pulses. The ion beams are generated in an ultrathin diamondlike carbon (DLC) layer by high-intensity and ultrahigh-contrast laser pulses. In this way, due to the efficient volumetric heating of electrons in said carbon layer as a consequence of ultrahigh laser intensity resulting in relativistic transparency, a maximal energy of 15 MeV/nucleon can be obtained at the optimal layer thickness. The ion beam generated in this manner has got an extremely wide energy spectrum that excludes a direct application in hadron therapy.

In laser pulse driven particle acceleration as described in the above identified patents and publications, the acceleration of charged particles to relatively low energies—1 to 10 MeV/nucleon—can be attained which does not allow the penetration into the required tissue depths in cancer therapy applications. A yet more significant problem for most applications, however, is that the energy spectrum of ions accelerated in this way is rather wide, i.e. the energy spread of a thus generated ion beam is quite large and, hence, it cannot be used for hadron therapy purposes at all.

According to most recent prior art technique, a maximum proton energy of 58 MeV can be achieved via laser-acceleration through the application of an extreme large laser intensity of 600 EW/cm$^2$ (for further details, the reader is referred to a paper by Robson at al. [Nature Physics 3, 58 (2007)]). This energy is yet, however, too low for hadron therapy applications on the one hand, and on the other hand large width of the energy spectrum of the thus generated proton beam makes this type of application impossible.

The scientific paper by Haberberger et al. entitled *Collisionless shocks in laser-produced plasma generate monoenergetic high-energy proton beams* [Nature Physics 8, 95 (2012)] teaches a technique to produce bunches of energetic protons of 20 MeV with narrow (below 1%) energy spread. According to this technique, the proton bunches are generated in a gas using trains of pulses emitted by a high-power $CO_2$ laser. The experiences show relatively high (up to 20-30%) pulse-to-pulse fluctuations in the mean energy of two subsequently created proton bunches that renders the thus obtained proton beam totally inappropriate for hadron therapy applications. To allow applicability, the energy spread in said mean energy has to be decreased. The energy of 20 MeV attainable by this technique at present is also insufficient for hadron therapy applications, but represents a good starting point to accelerate further and, thus, to produce proton beams with energies required by hadron therapy.

An example for particle acceleration using the evanescent field of an electromagnetic wave undergoing total internal reflection at a medium boundary is disclosed in U.S. Pat. No. 3,267,383, as well as in the paper by R. C. Fernow entitled *Acceleration using total internal reflection* [Center for Accelerator Physics, Physics Department, Brookhaven National Laboratory Associated Universities, Inc. Upton, Long Island, N.Y. 11973].

The scientific paper by T. H. Koschmieder entitled *Evanescent wave acceleration of electrons from* 0.2 *c to* 0.95 *c* [Particle Accelerators, 48, 75-84 (1994)] expressedly relates to the acceleration of electrons. According to its teaching, the acceleration of ultrafast electrons to relativistic energies is to be performed by employing the evanescent field of radio frequency electromagnetic waves. The extreme long wavelength used in the technique as disclosed in the paper limits focusability of the accelerated beam and, thus, allows merely the construction of an apparatus with extreme large dimensions: in particular, an energy increase falling in the order of several tens of MeV can be obtained along an acceleration length of about several tens of meter; this dimension is, however, highly disadvantageous, especially in case of the already mentioned hadron therapy treatments.

Theoretical possibilities of the acceleration of ultrarelativistic electrons using a symmetric evanescent filed are studied by B. R. Frandsen et al. in the paper entitled *Acceleration of Free Electrons in a Symmetric Evanescent Wave* [Laser Physics, 16, 1311-1314 (2006)] that is considered to be the closest prior art as to the present invention. Said publication is, however, totally silent about the technical details of the implementation of the evanescent field driven acceleration; actually, the only piece of information provided in this respect is that high-intensity desktop lasers can be used as light source.

Although, the pulse energy and the peak electric field strength of laser sources operating in the visible or infrared wavelength ranges—and actually representing a basis for the above-discussed kinds of accelerator that propose the usage of the evanescent field of electromagnetic waves to accelerate electrically charged particle beams—would be appropriate for hadron therapeutical purposes, said laser sources still exhibit a major disadvantage. In particular, due to the short wavelength of said laser sources, they are inappropriate to form a spatial geometry required by the typical lateral size of charged particle beams to be accelerated, since the unobstructed passing of said particle beams would require a clear lateral gap of at least 50 μm in size.

A solution for collimating a laser-accelerated proton beam and for making it monochromatic in energy (i.e. to generate a monoenergetic proton beam) is disclosed in the paper by S. Ter-Avetisyan et al. entitled *First demonstration of collimation and monochromatisation of a laser-accelerated proton burst* [Laser and Particle Beams, 26, 637-642 (2008)]. A quadrupole magnetic lens system constructed from permanent magnets and operating as a tunable band-pass filter is proposed for this purpose, by means of which a rather significant increase in beam density can be achieved. It should be here emphasized that this system merely increases the spatial concentration of those protons in a proton beam of broadband energy spectrum, the energy of which falls into a close vicinity of a chosen energy value. The proton number distribution with respect to energy remains unchanged, that is, no actual energy increase and/or monocromatisation takes place here. A yet further disadvantage of this technique is that those particles, the energy of which falls outside the vicinity of said energy value, (due to the band-pass filter characteristics) simply get lost when the technique is applied.

In light of the above, the aim of the present invention is to provide such a method and such a compact setup to manipulate electrically charged particles, especially to accelerate said particles and/or to narrow the energy spread thereof, i.e. to make said particles monoenergetic that eliminate the above-discussed deficiencies of the known solutions.

Our studies led us to the conclusion that to construct a compact-sized setup to accelerate electrically charged particles, especially ions, the wavelength range belonging to the far infrared (that is, the so-called terahertz) frequency range is the most appropriate.

Consequently, the present invention relates, in harmony with Claim 1 attached below, to a setup for particle acceleration, wherein the acceleration of electrically charged particles takes place using the evanescent field of THz frequency electromagnetic pulses (i.e. the pulse frequency falls into the frequency range of about 0.1 THz to about 10 THz).

Compared to traditional ion accelerators, an advantage of a setup according to the invention lies in its compactness and simpler construction. Moreover, it requires less space and is significantly more cost-effective both in terms of its production and operation. An advantage of the inventive setup over laser-driven ion acceleration is that it is capable of generating a quasi-monoenergetic particle beam with significantly smaller energy spread. A yet further advantage of the inventive setup is that, due to its simple construction and compactness, an accelerated beam can be produced in the vicinity of the point of use; this is an aspect of great importance e.g. in cancer therapy applications. Moreover, the inventive setup also allows the acceleration of a charged particle beam with a relatively narrow energy spectrum to an extent that is required by target applications.

In order to achieve an efficient (i.e. maximal) acceleration, synchronization between the particles to be accelerated and the electromagnetic pulse used for the acceleration also represents an important technical problem to be solved. Here, "synchronization" means that the velocity of the evanescent field used to accelerate the particles should be matched with the continuously increasing velocity of the accelerated particles at every instant. It is noted that amongst the above cited documents related to particle acceleration only the paper by T. H. Koschmieder entitled *Evanescent wave acceleration of electrons from* 0.2 *c to* 0.95 *c* mentions the problem of synchronization. To accomplish synchronization, said scientific paper proposes either to alter the refractive index of the medium in which the electromagnetic pulse propagates, or to continuously change the angle of incidence of said electromagnetic pulse, or to form the surface of incidence of said medium with proper curvature. Practical realizations of these proposals, nevertheless, are rather elaborate and they can be hardly implemented if at all. Practicing of the disclosed theoretical options is especially problematic when electromagnetic waves in the radio frequency range are used, as it is proposed in this paper.

In case of acceleration of protons—contrary to that of relativistic electrons—it is of great importance to ensure synchronization since for a certain set of accelerating field parameters the achievement of a desired energy increase is accompanied by a much larger change in velocity. Starting from the rather elaborate realizability of the synchronization techniques proposed by T. H. Koschmieder, various calculations have been performed in order to have insight into how an efficient acceleration of charged particles could be accomplished in practice. Based on the results of the calculations, we have arrived to the conclusion that the velocity and phase of the accelerating pulse can be chosen optimally for the entrance velocity of the particles. The optimal velocity can be calculated in an analitic way, its value is larger than the entrance velocity of the particles to be accelerated. According to the present invention, the speed of the accelerating evanescent field and its phase are optimized via choosing the angle of incidence of the THz-pulse appropriately and by inducing a delay known by a person skilled in the field of optics, respectively.

Thus, the present invention is based on the following findings:

(i) the evanescent field of a terahertz electromagnetic wave (i.e. that falls into the frequency range of 0.1 to 10 THz) undergoing total internal reflection at a boundary of the medium in which it propagates can be used to accelerate electrically charged particles if the electric field strength of said terahertz radiation is large enough; and (ii) as a consequence of the order of magnitude of the wavelength range that corresponds to the THz frequency range of the electromagnetic waves to be used for accelerating charged particles, optical elements providing the build-up of evanescent field can be arranged in such a peculiar geometry, in which the electrically charged particles can freely propagate all along their trajectory during acceleration.

Some major features of the terahertz particle accelerator setup according to the present invention ensue from the construction of said setup that comprises

- a terahertz radiation source capable of generating THz electromagnetic pulses comprising preferably a few optical cycles and characterized by an electric field that has a peak value at least in the order of MV/cm, and
- a pair of bulk crystals that forms optical elements arranged symmetrically along the propagation trajectory of the electrically charged particles to be accelerated, wherein
- the members of said pair of bulk crystals are identical and made of the same kind of substance, and
- the substance of the bulk crystals exhibits a large optical destruction threshold field strength value, as well as small absorption and low dispersion over the terahertz domain,
- said pair of bulk crystals and the terahertz radiation source are arranged in such a way that when a terahertz radiation provided in the form of electromagnetic pulses generated by said terahertz radiation source is directed through the members of the pair of bulk crystals separated by a gap from one another, said terahertz radiation suffers total internal reflection and thus an accelerating evanescent field builds up in said gap.

Depending on the frequency of the THz electromagnetic pulses used for the acceleration, the separation distance between the bulk crystal optical elements preferably falls between several tens of μm and about 150 μm; more preferably, said separation distance is about 50 μm.

Possible further embodiments of the particle accelerator setup according to the present invention are set forth in Claims 2 to 11. Furthermore, Claims 12 and 13 relate to an apparatus obtained by applying several particle accelerator setups according to the invention after each other, as separate accelerator stages.

A method to manipulate electrically charged particles in accordance with the present invention is defined by Claim 14, while possible preferred variants of the inventive method are set forth in Claims 15 to 22.

In what follows, the invention will be explained in more detail through preferred embodiments thereof with reference to the attached drawings. In the drawings FIG. 1 is a three-dimensional basic diagram of a terahertz particle accelerator setup according to the invention, wherein the terahertz radiation source is not shown for the sake of clarity;

Basic construction of a terahertz particle accelerator setup 1 according to the present invention is outlined with reference to FIGS. 1, 2A, 2B and 3. Particle accelerator setup 1 illustrated in FIG. 1, as well as in FIGS. 2A and 2B (first embodiment) includes one or two THz radiation sources 5 (emitting i.e. at a frequency falling into the frequency range of 0.1 to 10 THz) for accelerating a particle beam 4 of electrically charged particles (in particular, ions, such as protons), as well as optical elements 2 adapted to accelerate said particle beam 4 by means of the evanescent field/fields of the THz electromagnetic pulses emitted by the one or two radiation sources 5. In this embodiment of the particle accelerator setup 1, the optical elements 2 are formed e.g. by a pair of identical bulk crystal elements arranged in a configuration that is mirror symmetric to a symmetry plane S shown in FIG. 2A and made of the same kind of substance. As far as the optical properties of said bulk crystal optical elements 2 are concerned, they can be considered homogeneous, i.e. the refractive indices thereof are of the same magnitude in the whole volume thereof. It is noted that said optical elements 2 can be equally made of such substances, the optical properties/behaviour (e.g. absorptions, refractive indices, dispersions, etc.) of which are equivalent over the THz domain.

Figure 1:
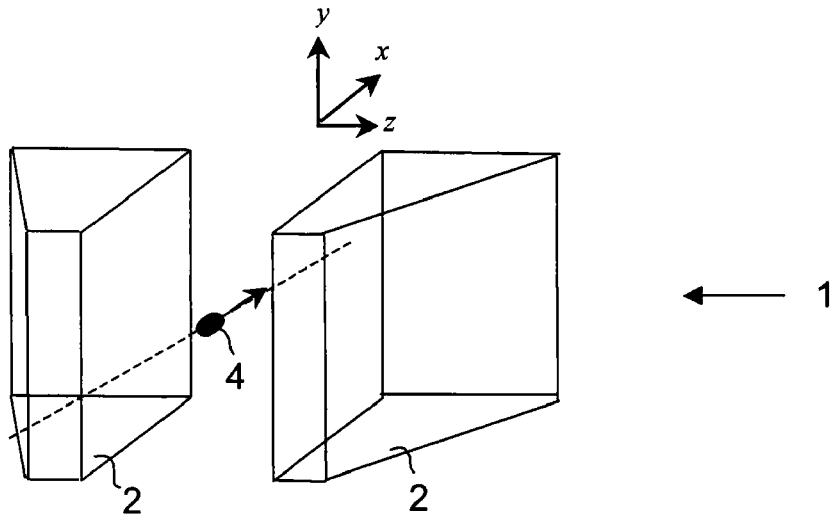
Figure 2A:
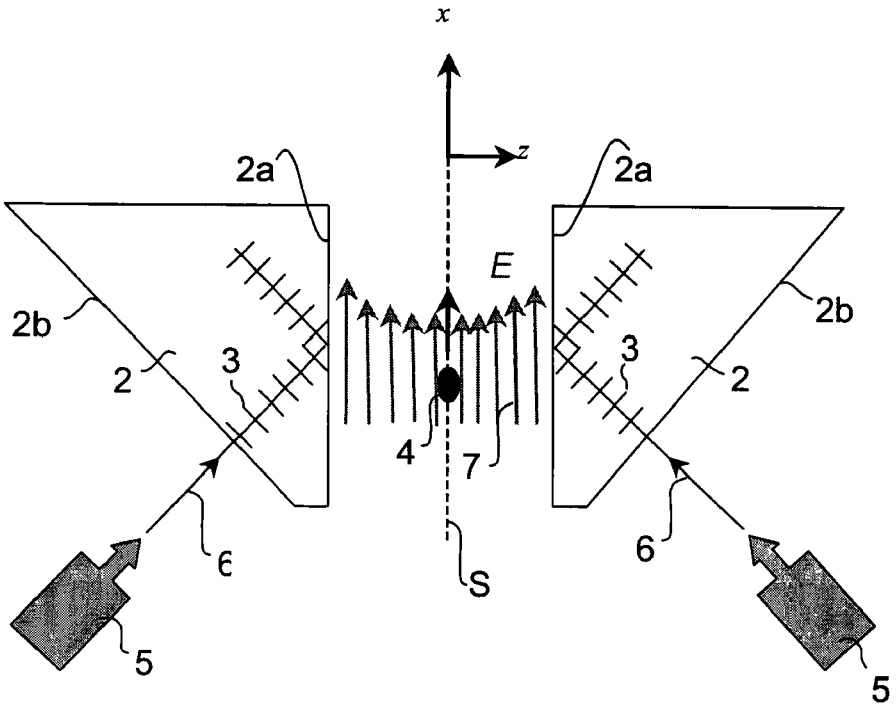
FIG. 2A is a top view illustrating the terahertz particle accelerator setup and its principle of operation, wherein the wavefronts and the spatial distribution of the longitudinal component of the electric field strength of the evanescent wave are also shown.

The bulk crystal optical elements 2 are provided in the form of (preferentially normal) prisms delimited preferably by base surfaces and lateral faces, wherein several lateral faces of said prisms are optical grade polished plane surfaces; in this embodiment, e.g. first 2*a* and second 2*b* faces shown in FIG. 2A. The optical elements 2 are arranged along the trajectory of the particle beam 4 to be accelerated, on the opposite sides thereof; here, the same polished faces of the optical elements 2 face to, are parallel with and transversally apart from each other. In case of said first embodiment, during acceleration, the particle beam 4 to be accelerated propagates between said parallel first faces 2*a* of the bulk crystal optical elements 2, in particular, as it is illustrated in FIG. 1. For each bulk crystal optical element 2, the first face 2*a* forms a given angle with the second face 2*b*. This angle is, however, application dependent; for a certain application, however, a skilled person in the art can easily determine it in advance in every case by performing simple calculations, yet in the design phase of the particle accelerator setup required for the application—in this respect, see e.g. the Example to be discussed later.

Figure 2B:
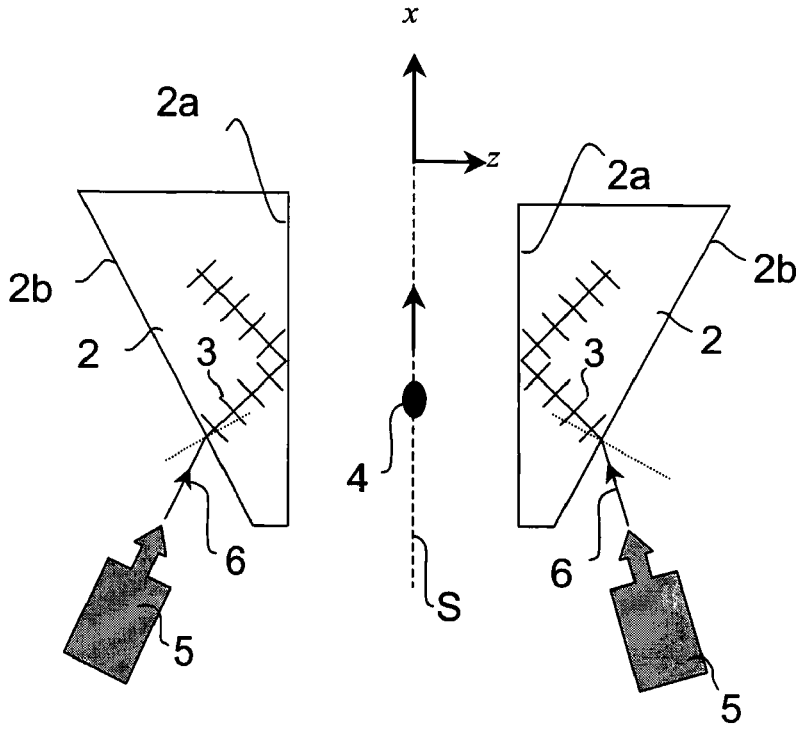
FIG. 2B shows a further example for coupling the THz electromagnetic radiation into the bulk crystal.

When the particle accelerator setup 1 is in operation, beams 6 formed by the THz-pulses emitted by the radiation sources 5 (operated synchronously) are coupled into each of the bulk crystals through a further polished lateral face of the optical element 2, in case of the first embodiment, in particular, through the second face 2*b*, essentially at right angle to the crystal surface, as it is illustrated in FIG. 2A. To decrease reflection losses, a more preferred embodiment is provided by the setup illustrated in FIG. 2B, wherein the beams to be coupled in strike the second (i.e. coupling-in) faces 2*b* of respective bulk crystal optical elements 2 at Brewster's angle (here, and from now on, all angles of incidence are measured from the incidence norm perpendicular to the surface). In both optical elements 2, the electromagnetic pulses impinge on the boundary surfaces formed by the parallel first faces 2*a* at a given angle, obliquely, wherein they undergo total internal reflection. Said two beams 6 travel within the optical elements 2 in a mirror-symmetric manner. FIGS. 2A and 2B illustrate this geometrical configuration in top view, here wave fronts 3 of the electromagnetic radiations coupled into the bulk crystal optical elements 2 and travelling in said optical elements towards the parallel first faces 2*a* are also shown. It is noted here, that the THz beams 6 can be generated by a single radiation source 5 as well; in such a case, the single beam generated by said single radiation source is split—before it is coupled into said optical elements—into two beams of preferably essentially equal intensity by means of one or more suitable optical elements in a way known by a person skilled in the relevant art.

As it is known, in case of total internal reflection, the electric field crosses from the optically dense medium into the optically rare medium, and it appears in said rare medium as an evanescent wave, the amplitude of which decreases (generally exponentially) with the distance measured from the boundary surface. The extent of decrease depends on the wavelength of the radiation, the refractive indices of the two media, as well as the angle of incidence. The particle accelerator setup 1 according to the present invention is based upon this specific property of the electromagnetic waves propagating in said bulk crystal optical elements 2 and suffering total internal reflection at the first faces 2*a*, acting as medium boundaries. In particular, in the mirror-symmetrical configurations of FIGS. 2A and 2B, an evanescent electromagnetic wave is present within the region located between the first faces 2*a* of the bulk crystal optical elements 2, the electric field strength (E) of which can be determined based on the principle of superposition. The speed of the phase of the electrical field strength 7 points into direction x (in the Cartesian coordinate system shown in FIG. 1) within the region between the bulk crystal optical elements 2, while its magnitude corresponds to the sweeping speed of the line of intersection of the wave fronts 3 coming from the optically dense medium and the medium boundary defined by the first face 2*a*.

The particle beam 4 to be accelerated travels essentially in the plane of symmetry S that fits on the x-axis. Consequently, said particle beam 4 is accelerated by a longitudinal (i.e. pointing into direction x) component of the electric field strength of the evanescent wave. Spatial distribution of the longitudinal distribution of said electric field strength is illustrated schematically in FIG. 2A. As the bulk crystal optical elements 2 are arranged symmetrically, this field strength component is minimal in the plane of symmetry S. However, the electric field that builds up between the optical elements 2 has also got a non-zero component pointing into direction z. Moreover, within the region between said bulk crystals, apart from the plane of symmetry, the magnetic field will point into direction y (see the paper by B. R. Frandsen et al. entitled *Acceleration of Free Electrons in a Symmetric Evanescent Wave* [Laser Physics, 16, 1311-1314 (2006)], and/or the text book of J. D. Jackson entitled *Classical Electrodynamics*, Third Edition, Wiley, 1999, ISBN 047130932X, 9780471309321). The transversal (i.e. pointing into direction z) overall force emerging due to the electric field pointing into direction z and the magnetic field pointing to direction y advances with 90° in phase relative to the longitudinal electric force. When the longitudinal accelerating force acting on the particles in the particle beam 4 is maximal, the transversal force is just zero. This means, that by means of suitably timing the interaction between the electromagnetic pulse emitted by the radiation source 5 and the individual particles, it can be achieved that upon accelerating said particle beam 4, no significant beam widening will be induced by the transversal forces. Hence, the separation between said bulk crystal optical elements 2 can be chosen in such a way that, on the one hand, the particle beam 4 can freely travel through (i.e. "fits" into) between the optical elements 2 despite its transversal beam size variation due to the interaction with the transversal component of the evanescent field and, on the other hand, the magnitude of the electric field strength of the accelerating electric field 7 in the plane of symmetry S exceeds half of the magnitude of the field strength measured on the side of said optical elements 2 that has a smaller optical refractive index (that is, in air or in vacuum). According to our studies, the above conditions are fulfilled if the separation length of the optical elements 2 falls preferably between several tens of μm and about 150 μm.

As it is apparent in light of the above, to accelerate the particle beam 4, there is a need to provide an evanescent field of suitable peak electric field strength between the optical elements 2. Said suitable peak electric field strength falls in the order of MV/cm, that is, it is at least 1 MV/cm in magnitude. Such a peak electric field strength can be achieved, for example by means of the so-called pulse front tilting technique (in this respect, the reader is referred to the paper by J. Hebling, G. Almási, I. Z. Kozma and J. Kuhl, entitled *Velocity matching by pulse front tilting for large area THz-pulse generation* [Opt. Expr. 10, 1161 (2002)]) with making use of few-cycle THz-pulses (see the paper by H. Hirori, A. Doi, F. Blanchard and K. Tanaka entitled *Single-cycle terahertz pulses with amplitudes exceeding* 1 *MV/cm generated by optical rectification in* $LiNbO_3$ [Appl. Phys. Lett. 98, 091106 (2011)]). Furthermore, by improving said technique under the guidance of the paper by J. A. Fülöp, L. Pálfalvi, M. C. Hoffmann and J. Hebling entitled *Towards generation of mJ-level ultrashort THz pulses by optical rectification* [Opt. Expr. 19, 15090 (2011)], the attainable electric field strength of the evanescent field can be increased by several orders of magnitude.

The THz radiation source 5 playing an essential role in the THz particle accelerator setup 1 according to the present invention provides the electric field required to accelerate the particle beam 4. Said radiation source 5 generates THz-pulses with a few optical cycles that are practically comprised of merely several oscillation cycles and thus the pulse duration falls into the picosecond (ps) domain.

A further essential element of the particle accelerator setup 1 according to the present invention is the pair of optical elements 2 provided by said bulk crystals machined in a specific manner. To provide an evanescent field of suitable magnitude within the region between the optical elements 2 along the trajectory of the particle beam 4, the substance of said optical elements 2 will fulfil the following requirements over the THz frequency range:

its absorption coefficient preferably does not significantly exceed the values in the order of $cm^{-1}$, that is, it is at most 10 $cm^{-1}$;

its refractive index is of suitable magnitude, which is specified by the condition that the sweeping speed of the line of intersection of the wave fronts 3 and the medium boundary defined by the first face 2*a* should be matched with the entrance velocity of the particles in the particle beam 4 to be accelerated when entering the region between said optical elements 2. This latter condition requires a relatively large refractive index over the THz frequency domain; our calculations performed for various initial conditions showed that the refractive index of the substance of the optical elements 2 is at least four; in particular, for the compact setup of the below Example (to be discussed later on), a condition of n≈5 holds for the refractive index of the substance of the optical elements over the THz frequency range;

it has low dispersion, that is, the value of the phase refractive index differs from that of the group refractive index by at most several tenths of percentages; and the electric field strength corresponding to the optical destruction threshold of said substance exceeds the values in the order of MV/cm, that is, it is preferably at least 10 MV/cm in magnitude.

Considering the above requirements, for the present invention, germanium and silicon are the preferred substances; their THz optical properties are summarized e.g. in the reference book *Handbook of Optical Constants of Solids I* (published by Academic Press, New York, 1985, edited by E. D. Palik).

The above detailed THz particle accelerator setup 1 provides a compact, as well as an easily accomplishable solution for particle acceleration. Compactness can be further improved in a possible yet further embodiment of the setup according to the invention. To this end, the above discussed pulse front tilting technique is practiced with a so-called contact grating [see the paper by L. Pálfalvi, J. A. Fülöp, G. Almási and J. Hebling entitled *Novel setups for extremely high power single-cycle terahertz pulse generation by optical rectification*, Appl. Phys. Lett. 92, 171107 (2008)] instead of making use of the combination of an optical grating/imaging element/non-linear medium. This further embodiment can be attained by bringing each bulk crystal optical element 2 into optical contact with an optical grating or an optical grating with appropriate properties is formed on the second faces 2*b* of each said bulk crystal optical element 2 by means of a suitable manner known by a skilled person in the art. Such an embodiment of the THz particle accelerator setup according to the invention is illustrated schematically in FIG. 3.

Figure 3:
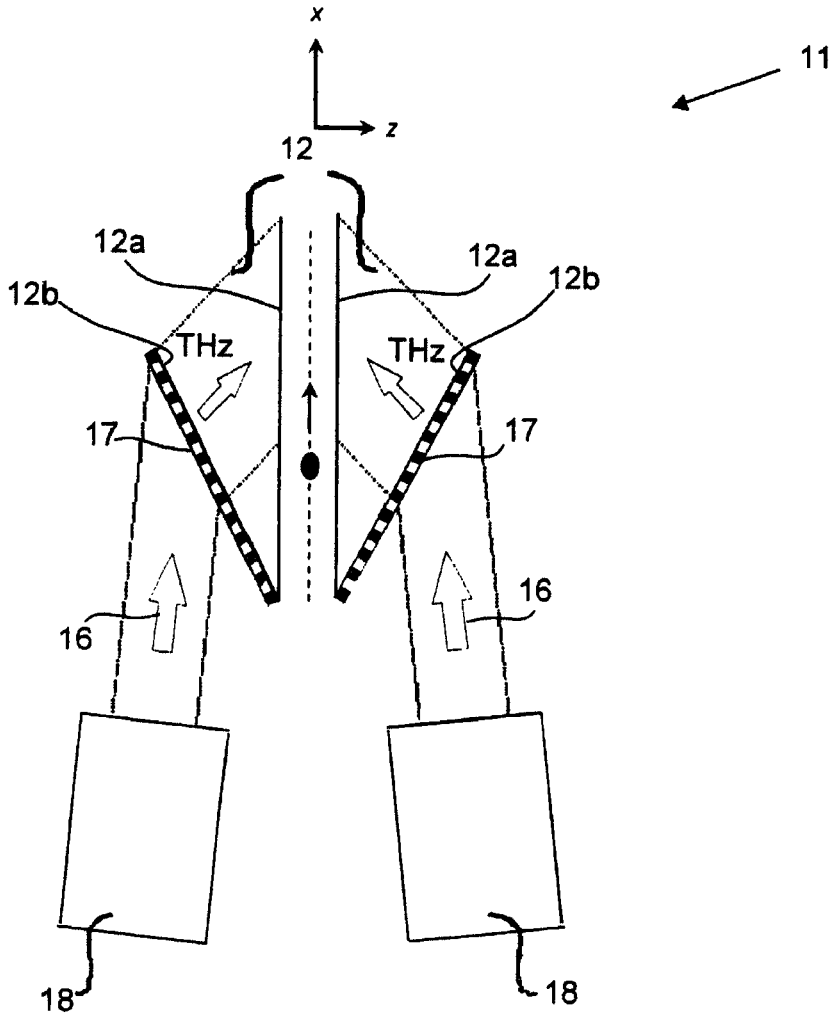
FIG. 3 illustrates a possible further embodiment of the terahertz particle accelerator setup according to the invention, wherein the terahertz radiation source and the bulk crystal are present in the form of a single integral unit.

Each optical element 12 in the particle accelerator setup 11 shown in FIG. 3 (second embodiment) is provided by the combination of a prism-shaped bulk crystal element with second and first faces 12*b*, 12*a* located along the direction of light propagation, in the given order, that ensures total internal reflection (at said first face 12*a*) and a contact grating 17 arranged on or formed in said second face 12*b*. The contact gratings 17 are formed with a grating period that equally enables that said optical elements 12 can be used as tilted pulse front terahertz radiation source(s) as well. Accordingly, in this case, the identical optical elements 12 arranged symmetrically along the trajectory of the particle beam (not shown) and carrying contact gratings 17, as well as pumping lasers 18 emitting coherent electromagnetic radiation 16 onto the contact gratings 17 represent major parts of the particle accelerator setup 11. The electromagnetic radiation 16 emitted by the pumping lasers 18 is preferably provided by pulses falling into the visible or the near infrared range. These pulses undergo pulse front tilting when travelling through the contact gratings 17 (optically) coupled with the optical elements 12 and then are coupled into said optical elements 12, induce a THz radiation in the bulk material thereof, said radiation suffers total internal reflection at the faces 12*a* of said optical elements 12, acting as boundary surfaces. The bulk crystal elements are made of a substance that, along with satisfying the above detailed requirements, has also got a relatively high, i.e. at least several tens of pm/V, second order non-linear optical coefficient. It is noted hereby, that said pumping lasers 18 can be replaced by a single pumping laser if various synchronizing techniques and beam guiding optical means known by a skilled person in the art are applied this also contributes to a realizability of the particle accelerator setup 11 in a more compact form. In harmony with the above requirements, the optical elements 12 formed by said bulk crystals of the particle accelerator setup 11 illustrated in FIG. 3 are preferably made of $LiNbO_3$ (LN); however, to produce them, zinc telluride (ZnTe) or gallium arsenide (GaAs) can be equally used.

Due to the operation principle of the invention, it is a requirement that the particles to be accelerated have already some speed (energy) when entering the particle accelerator setup 1, 11. This speed typically falls in the order of the speed of light in vacuum, the corresponding energy is several tens of MeV. Therefore, the particle accelerator setup according to the present invention is apt for accelerating further either particles that are pre-accelerated by means of a traditional microwave accelerator and/or those particles of a wide energy spectrum beam generated by a laser-driven accelerator, the energy of which is in a narrow range of a pre-determined energy value.

As it was mentioned earlier, in case of particle acceleration by means of an electromagnetic pulse, a fundamental object is that a particle of a certain energy to be accelerated further employ the energy of the electromagnetic pulse in the most optimal way possible. This can be attained by synchronizing the particle and the electromagnetic pulse. In case of the terahertz particle accelerator setups 1, 11 according to the present invention this particularly means that the phase velocity of the evanescent field and/or its initial phase are matched to the particle of a given speed entering between the optical elements 2, 12. Setting the phase velocity takes place by setting the angle of incidence of the THz beams to the first faces 2*a*, 12*a* of said optical elements 2, 12. The initial phase can be set by means of inducing a delay between the THz-pulse and the particle propagating through the evanescent field of said THz-pulse through optical techniques known by a skilled person in the art. Setting the values of the optimal phase velocity, initial phase, as well as the optimal acceleration length defined by these parameters takes place on the basis of theoretical calculations performed in advance for each geometrical configuration of interest.

In what follows, the inventive solution is exemplified further through a definite embodiment thereof without limiting the scope of protection claimed in any way.

EXAMPLE

Model calculations required to realize the particle accelerator setup 11 were performed for optical elements 12 made of LN and constructed with contact gratings 17. As particles to be accelerated protons with initial energy of 40 MeV were assumed, the speed corresponding to this energy is 0.283·c, here c stands for the speed of light in vacuum. In this exemplary case the calculations result in an optimal effective (i.e. parallel to the velocity of particles) THz phase velocity of 0.287·c. To achieve this velocity value, in case of LN bulk crystals, an angle of incidence of 45° is required to the first face 12*a*. Assuming a pumping wavelength of 1030 nm and a grating with a line density of 2000 $mm^{-1}$, to set the above velocity value and/or to provide a pulse front tilting necessary for generating a THz radiation within the material of said bulk crystal, the angle of incidence of the pumping beam to the grating is 5.4°, while the angle made by the first face 12*a* and the contact grating 17 (that is, practically the second face 12*b*) will be 44.5°. The central frequency of the THz-pulses used for the acceleration is 0.5 THz, as according to the paper by J. A. Fülöp, L. Pálfalvi, M. C. Hoffmann, J. Hebling entitled *Towards generation of mJ-level ultra-short THz pulses by optical rectification* [Opt. Expr. 19, 15090 (2011)], in terahertz electromagnetic pulses the greatest electric field strength can be generated at this frequency. The magnitude of the assumed electric field strength not exceeding the optical destruction threshold is 1.7 MV/cm within the LN bulk crystals, the distance between the parallel first faces 12*a* of the optical elements 12 realized by making use of LN bulk crystals is preferably about 50 μm. According to the calculations performed, the protons with initial energy of 40 MeV gain energy of 42.6 MeV along an acceleration length of 2.8 cm during a half optical cycle (with positive field strength) if the electric field of said THz-pulse is fully exploited. The dispersion in LN, which is the difference between the group delay and the phase delay along the given acceleration section, sets a lower limit for the pulse duration of the THz-pulses used for inducing acceleration. Here, said pulse duration makes out 0.7 ps, which means that the inventive solution concerned, that is, the acceleration of said proton beam can be realized in the exemplary configuration along with applying few-cycle THz-pulses, since pulse duration of few-cycle THz-pulses is larger than this value.

For a skilled person in the art it is apparent, that the model calculation of the Example can be equally performed for other configurations, too, wherein a different substance for the bulk crystal and a THz-pulse with different central frequency for inducing the acceleration are assumed, as well as a charged particle beam of different initial energy and type is considered, as a result of which a separation distance of said first faces 12*a* of the optical elements 12 differing from the preferred value given in the Example will be attained, said distance will fall preferentially between several tens of μm and about 150 μm.

The above Example demonstrates the capability of the inventive solution, according to which protons gain about 1 MeV in energy along an acceleration length of about 1 cm, contrary to the examples discussed in said paper by T. H. Koschmieder, wherein the same increase in energy of electrons could be obtained along a distance in the order of meters.

Depending on the energy to be achieved, the particle accelerator setup according to the invention can be arranged along the trajectory of the particle beam to be accelerated more than once, sequentially. When such a configuration is used, the particle and the accelerating electromagnetic filed must be synchronized with one another at the entry to each individual accelerator stage. This is achieved preferably via setting the phase velocity and the initial phase of the evanescent field to optimal values. Setting of the phase velocity takes place by setting the angles of incidence of the THz beams to the first faces 2*a*, 12*a* of the optical elements 2, 12. The initial phase can be set through generating a delay between the THz-pulse and the particle by means of optical techniques known by a person skilled in the art. According to the studies performed, in a particle accelerator setup 1, 11 according to the invention, a proton beam with the initial energy of 40 MeV can be accelerated into a beam with an energy that is already adequate for e.g. radiation therapy applications, i.e. to about 70 MeV, preferably in ten stages (that is, in a configuration, wherein ten pieces of the particle accelerator setup 1, 11 are arranged along the trajectory of the proton beam).

Hadron therapy applications require a particle beam with small energy spread (i.e. a monochromatic beam). By simulating the interaction of bunches of particles with an accelerating field provided by THz-pulses, it could be concluded that the present invention—as a consequence of its operation principle—can be also applied for the monochromatisation of the particles along with their simultaneous acceleration if the parameters are chosen properly. By inducing a suitable amount of delay between the accelerating field and the particles, said delay being defined by geometrical parameters of the particle accelerator configuration concerned, it can be achieved that the particles travelling ahead within the bunch of particles that has a length shorter than the wavelength of the accelerating field (i.e. which are faster) will be decelerated by said accelerating field, and the particles staying behind (i.e. which are slower) will be accelerated in a greater extent compared to those particles for which the above discussed phase matching condition holds. In this way, narrowing the energy spectrum of the particle beam is performed simultaneously with accelerating the particles in the particle beam, that is, the method and the setup to accelerate particles according to the present invention are also apt for a simultaneous monochromatisation besides the acceleration of particles. It is, however, important to note here that an efficient acceleration and a monochromatisation can be simultaneously attained only for a certain portion of the particle beam to be accelerated that depends on the parameters of the accelerating field and the energy distribution of the particles emitted by the particle source. Contrary to the solution disclosed in the paper by S. Ter-Avetisyan et al. entitled *First demonstration of collimation and monochromatisation of a laser-accelerated proton burst*, which is actually an apparatus that operates as a simple band-pass filter and, hence, filters out a significant amount of the incoming particles, according to our calculations, under the conditions outlined in relation to the explanation of the inventive solution and especially the Example, as well as in the case of actual proton sources available, for an amount of protons required by target applications (e.g. hadron therapy), a simultaneous acceleration and monochromatisation to an adequate extent can be accomplished.

In case of hadron therapy applications, the treatment beam is comprised of, in general, more than one bunches of particles one after the other in time. As far as the mean energy is concerned, such bunches of particles generated by laser pulses are rather spread, as it is also discussed in the paper by Haberberger et al. entitled *Collisionless shocks in laser-produced plasma generate monoenergetic high-energy proton beams*. Due to its operation principle, through the application of a particle accelerator setup according to the invention, the spread present in the mean energy of the thus generated bunches of particles can be decreased significantly, even to an extent below 1%.

In hadron therapy applications a yet further important requisite is beam collimatedness. To attain this, there is a need to decrease the amount of divergence of the highly divergent particle beam leaving e.g. the laser-driven accelerator. Based on the results of theoretical calculations, this can be preferably achieved by a particle accelerator that comprises at least two particle accelerator setups according to the invention in the form of separate accelerator stages, and wherein in order to provide efficient acceleration and monochromatisation, a first accelerator stage is arranged in the vicinity (i.e. at a distance in the order of cm) of the particle source. Proximity to the particle source ensures that an adequate amount of particles emitted by said particle source enters the particle accelerator. To efficiently accelerate further and to preserve monochromaticity of the monochromatic particle beam leaving said first stage, a second accelerator stage can be arranged even at a distance of several tens of cm from the first one. In this way, to decrease beam divergence, it is also possible e.g. to insert focusing elements (preferably e.g. quadrupole magnets) into between the individual accelerator stages.

By exploiting the inventive solutions, a monochromatic and collimated, electrically charged particle beam with sufficient energy for e.g. hadron therapy applications can be produced.

It should be here noted that the method and the setup according to the invention are also applicable (along with obvious rescaling) to make electrons—besides ions—monochromatic in energy, that allows numerous other practical applications of the inventive solutions, as it is apparent to a person skilled in the relevant field.

Furthermore, the inventive solutions are not limited merely to the embodiments detailed in the previous description and to the Example; the scope of protection claimed also covers crystals, besides the materials mentioned above, with similar material parameters.

The invention claimed is:

1. A particle accelerator apparatus to accelerate electrically charged particles, comprising:

a terahertz radiation source (5, 18) adapted to emit electromagnetic pulses with a frequency in a frequency range of 0.1 to 10 THz and characterized by an electric field having a peak electric field strength in an order of MV/cm;

a first optical element (2, 12) with planar first and second faces (2*a*, 12*a*; 2*b*, 12*b*); and a second optical element (2, 12) with planar first and second faces (2*a*, 12*a*; 2*b*, 12*b*), said first and second optical elements (2; 12) being in the form of identical objects made of a same substance, wherein said optical elements (2, 12) are arranged symmetrically with said first faces (2*a*, 12*a*) facing to and parallel with each other and defining a gap therebetween with a size that allows unobstructed passing of the particles to be manipulated between said faces, wherein the substance of said optical elements (2, 12) being optically transparent over the frequency range of 0.1 to 10 THz and exhibiting large optical destruction threshold field strength and low dispersion, wherein said first and second optical elements (2, 12) and said terahertz radiation source (5, 18) are arranged in such a way that terahertz radiation emitted by the terahertz radiation source (5, 18) in a form of said electromagnetic pulses suffers total internal reflection at the first faces (2*a*, 12*a*) when passing through said first and second optical elements (2, 12).

2. The particle accelerator apparatus (1, 11) according to claim 1, wherein the absorption coefficient of the substance of said optical elements (2, 12) is at most 10 $cm^{-1}$ over the frequency range of 0.1 to 10 THz.

3. The particle accelerator apparatus (1, 11) according to claim 1, wherein the optical destruction threshold field strength of the substance of said optical elements (2, 12) is at least 10 MV/cm over the frequency range of 0.1 to 10 THz.

4. The particle accelerator apparatus (1, 11) according to claim 1, wherein the refractive index of the substance of said optical elements (2, 12) is at least four over the frequency range of 0.1 to 10 THz.

5. The particle accelerator apparatus (1, 11) according to claim 1, wherein a difference between phase and group refractive indices of the substance of said optical elements (2, 12) is at most several tenths of percentages.

6. The particle accelerator apparatus (1, 11) according to claim 1, wherein said terahertz radiation source (5, 18) is adapted to emit few-cycle electromagnetic pulses.

7. The particle accelerator apparatus (1, 11) according to claim 1, wherein a separation distance between said first faces (2, 12*a*) of the optical elements (2, 12) falls between several tens of μm and about 150 μm.

8. The particle accelerator apparatus (1, 11) according to claim 7, wherein the separation distance between said first faces (2, 12*a*) of the optical elements (2, 12) is about 50 μm.

9. The particle accelerator apparatus (1, 11) according to claim 1, wherein the optical elements (2) are made of silicon or germanium.

10. The particle accelerator apparatus (11) according to claim 1, wherein a contact grating (17) is arranged on or formed in said second face (12*b*) of each optical element (12) in optical coupling with the respective optical element (12).

11. The particle accelerator apparatus (11) according to claim 10, wherein the optical elements (12) are made of $LiNbO_3$.

12. An apparatus to manipulate electrically charged particles, comprising at least two particle accelerator setups (1) being arranged sequentially as separate accelerator stages, wherein individual ones of the at least two particle accelerator setups comprise:

a terahertz radiation source (5, 18) adapted to emit electromagnetic pulses with a frequency in a frequency range of 0.1 to 10 THz and characterized by an electric field having a peak electric field strength in an order of MV/cm;

a first optical element (2, 12) with planar first and second faces (2*a*, 12*a*; 2*b*, 12*b*); and a second optical element (2, 12) with planar first and second faces (2*a*, 12*a*; 2*b*, 12*b*), said first and second optical elements (2; 12) being in the form of identical objects made of a same substance, wherein said optical elements (2, 12) are arranged symmetrically with said first faces (2*a*, 12*a*) facing to and parallel with each other and defining a gap therebetween with a size that allows unobstructed passing of the particles to be manipulated between said faces, wherein the substance of said optical elements (2, 12) being optically transparent over the frequency range of 0.1 to 10 THz and exhibiting large optical destruction threshold field strength and low dispersion, wherein said first and second optical elements (2, 12) and said terahertz radiation source (5, 18) are arranged in such a way that terahertz radiation emitted by the terahertz radiation source (5, 18) in a form of said electromagnetic pulses suffers total internal reflection at the first faces (2*a*, 12*a*) when passing through said first and second optical elements (2, 12).

13. The apparatus according to claim 12, wherein at least one focusing element is inserted between two consecutive stages, said focusing element configured to decrease divergence of the electrically charged particle beam.

14. A method to manipulate electrically charged particles, comprising:

arranging symmetrically two identical optical elements made of a same kind of substance and delimited by planar first and second faces in a configuration wherein said first faces are parallel with, facing to, and apart from each other, directing an electromagnetic pulse with a frequency falling into a frequency range of 0.1 to 10 THz and characterized by an electric field having a peak electric field strength in an order of MV/cm to the first face of both optical elements through the substance of said optical elements under conditions ensuring total internal reflection of the pulse at the first face, thereby generating an evanescent electromagnetic field within a region between said optical elements, passing the electrically charged particles to be manipulated through the evanescent electromagnetic field in a symmetry plane of said evanescent field parallel with said first faces of the optical elements in a direction of the electric field of the evanescent electromagnetic field in synchronization with the electromagnetic pulse, and thereby inducing an increase in speed of said particles.

15. The method according to claim 14, wherein said synchronization of the particles with the electromagnetic pulse is performed through changing an angle of incidence of said electromagnetic pulse to said first face of the optical element and an optical based delay of the particles, wherein the change in the angle of incidence and the optical based delay are determined by a calculation using parameters of the configuration and the substance.

16. The method according to claim 15, further comprising subjecting various portions along a propagation direction of the particles in a beam to a delay of different extents when the particles are passed through the evanescent field to change the speed of particles constituting various portions of the particle beam depending on a position of said particles within said particle beam, whereby an energy spread of the particles in the particle beam is made narrower.

17. The method according to claim 14, wherein a separation distance of said first faces of the optical elements is set commensurably with a transverse dimension of the particles to be manipulated.

18. The method according to claim 17, wherein the separation distance falls between several tens of μm and about 150 μm.

19. The method according to claim 14, wherein the electromagnetic pulse with a frequency falling into the frequency range of 0.1 to 10 THz is generated in a bulk portion of each optical element.

20. The method according to claim 19, further comprising phase-matching for generation of said electromagnetic pulse by employing pulse front tilting that is provided by applying a contact grating formed on/in said second face of each optical element.

21. The method according to claim 14, wherein the electromagnetic pulse with a frequency falling into the frequency range of 0.1 to 10 THz is coupled into a bulk portion of each optical element through the second face of the respective optical element.

22. The method according to claim 14, wherein the electromagnetic pulse with a frequency falling into the frequency range of 0.1 to 10 THz is provided by a THz-pulse comprised of a few optical cycles.

* * * * *